US005713406A

United States Patent [19]

Drury

[11] Patent Number: 5,713,406

[45] Date of Patent: Feb. 3, 1998

[54] PROTECTIVE CLOTH DIVIDER FOR CREDIT CARDS

[76] Inventor: Ronald N. Drury, 35117 N. Ravine La., Ingleside, Ill. 60041

[21] Appl. No.: 554,844

[22] Filed: Nov. 7, 1995

[51] Int. Cl.[6] ..... A45C 1/06; A45C 11/18

[52] U.S. Cl. ..... 150/132; 150/147; 206/39.5

[58] Field of Search ..... 206/37, 39, 39.4, 206/39.5; 150/131, 132, 138, 140, 147, 148, 149

[56] References Cited

U.S. PATENT DOCUMENTS

| | | | |
|---|---|---|---|
| 446,069 | 2/1891 | Low | 150/149 |
| 1,585,051 | 5/1926 | Skoglund | 150/149 |
| 2,328,400 | 8/1943 | Stanley | 150/140 X |
| 2,647,071 | 7/1953 | Schade | 150/132 X |
| 2,771,928 | 11/1956 | Hoeflin | 150/132 X |
| 3,299,929 | 1/1967 | Shagin et al. | 150/138 X |
| 3,324,918 | 6/1967 | Miller | 150/147 |
| 3,369,585 | 2/1968 | Hartinsen | 206/37 |
| 3,660,915 | 5/1972 | Davis . | |
| 3,856,063 | 12/1974 | Dengel | 150/132 |
| 4,105,057 | 8/1978 | Baumann et al. | 150/132 |
| 4,141,400 | 2/1979 | Mangan | 150/147 X |
| 4,593,736 | 6/1986 | Morita | 150/147 |
| 4,697,698 | 10/1987 | Holdener | 206/39.4 |
| 4,741,372 | 5/1988 | Santilli | 150/149 |
| 4,851,610 | 7/1989 | LeBlanc et al. | 150/147 X |
| 5,080,223 | 1/1992 | Mitsuyama | 150/147 X |
| 5,217,056 | 6/1993 | Ritter | 150/147 |
| 5,358,019 | 10/1994 | Sumner, III | 150/147 |

FOREIGN PATENT DOCUMENTS

| | | | |
|---|---|---|---|
| 515327 | 11/1992 | European Pat. Off. | 206/39 |
| 4135100 | 4/1993 | Germany | 150/149 |
| 4241642 | 6/1994 | Germany | 206/39 |
| 9117680 | 11/1991 | WIPO | 150/147 |

*Primary Examiner*—Sue A. Weaver
*Attorney, Agent, or Firm*—Meroni & Meroni

[57] ABSTRACT

A cloth divider for protecting credit cards, the cloth divider comprising: a substantially thin semi-rigid middle sheet, the semi-rigid middle sheet having a substantially rectangular configuration sized slightly smaller than a bank credit card; a substantially thin front protective cover sheet, the front protective cover sheet being uniformly secure to a front side of the semi-rigid middle sheet, the front protective cover sheet covering the front side of the semi-rigid middle sheet and being similar in size to the semi-rigid middle sheet; and a substantially thin back protective cover sheet, the back protective cover sheet being uniformly secured to a back side of the semi-rigid middle sheet, the back protective cover sheet covering the back side of the semi-rigid middle sheet and being similar in size to the semi-rigid middle sheet, the front protective cover sheet and the back protective cover sheet being soft enough to resist scratching when placed against a credit card thereby providing a semi-rigid cloth divider for placement adjacent to magnetic strips of credit cards within a wallet and protecting the magnetic strips of the credit cards from being damaged.

17 Claims, 2 Drawing Sheets

PROTECTIVE CLOTH DIVIDER FOR CREDIT CARDS

BACKGROUND OF THE INVENTION

1. Field of the Invention

The present invention relates generally to a divider for protecting plastic cards and more specifically to a divider that will protect the magnetic media and/or other information situated on a credit card, bank card, identification card, telephone card, copy card or the like.

2. Description of the Prior Art

Credit cards, bank cards, identification cards and other similar plastic cards are typically encoded with a magnetic media on a back side thereof. These cards are often subjected to daily removal and insertion from a person's wallet while making purchases or showing identification. Such cards are often placed in a wallet adjacent to other plastic cards thereby subjecting the magnetic media on the card to being scratched by other adjacent stiff plastic cards in the wallet, especially since such cards typically have additional protruding stiff indentations providing for the card number, person's name. expiration date and the like. These indentations add numerous scratches to the magnetic media of an adjacent card and therefore damaging the information stored on the magnetic media of the card and not allowing the card to be electronically read by a cash machine, credit card reader or the like.

Various different types of wallets and/or holders have been provided to protect plastic cards placed within a wallet. One such feature involves a wallet having pocket dividers for holding separate credit cards. These wallets typically do not have enough pocket dividers for a user, therefor making the user place multiple cards in each pocket and subjected the magnetic media on the cards to being scratched. Another method of protecting plastic cards is a see through type holder having a plurality of pockets slightly larger than the size of a credit card for holding plastic cards, identifications and pictures among other things. Again, these holders typically do not offer enough pockets for holding a user's cards and are also very inconvenient for one to use since one must locate an unused pocket and fit the card in between two slots. This usually becomes cumbersome to the user and is not always used. Furthermore, these holders tend to take up too much space within a wallet and do not last very long due to them ripping or falling apart after a short period of use.

Other various types of card holders have been developed, however, they do not offer the quick use and flexibility of my invention. Furthermore, other unique types of credit card holders and protectors are usually expensive and not easy to use and usually still result in a user placing a plastic card adjacent to another plastic card, thereby scratching the magnetic media on the card.

These and other types of credit card dividers disclosed in the prior art do not offer the flexibility and inventive features of my protective cloth divider for credit cards. As will be described in greater detail hereinafter, the protective cloth divider for credit cards of the present invention differs from those previously proposed.

It is therefore contemplated to provide an inexpensive and easy to use credit card protector that protects the magnetic media on plastic cards from being scratched when being inserted or removed from a wallet. It is further contemplated to provide a credit card protector that does not take up excessive space within a wallet thereby making the credit card protector easy and convenient to use.

SUMMARY OF THE INVENTION

According to my present invention I have provided a cloth divider for protecting credit cards, the cloth divider comprising: a substantially thin semi-rigid middle sheet, the semi-rigid middle sheet having a substantially rectangular configuration sized slightly smaller than a bank credit card; a substantially thin front protective cover sheet, the front protective cover sheet being uniformly secured to a front side of the semi-rigid middle sheet, the front protective cover sheet covering the front side of the semi-rigid middle sheet and being similar in size to the semi-rigid middle sheet; and a substantially thin back protective cover sheet, the back protective cover sheet being uniformly secured to a back side of the semi-rigid middle sheet, the back protective cover sheet covering the back side of the semi-rigid middle sheet and being similar in size to the semi-rigid middle sheet, the front protective cover sheet and the back protective cover sheet having a texture to resist scratching when placed against a credit card thereby providing a semi-rigid cloth divider for placement adjacent to magnetic strips of credit cards within a wallet and protecting the magnetic strips of the credit cards from being damaged.

Another feature of my invention relates to the cloth divider described above wherein the cloth divider has at least one U-shaped slot located on an edge of the cloth divider, whereby the U-shaped slot makes grasping of a credit card within a wallet easier.

Still another feature of my invention concerns the cloth divider described above wherein the cloth divider has at least one U-shaped protruding tab located on an edge of the cloth divider, whereby the U-shaped protruding tab makes locating and grasping of a credit card within a wallet easier.

Other objects, features and advantages of my invention will become more readily apparent upon reference to the following description when taken in conjunction with the accompanying drawings, which drawings illustrate several embodiments of my invention.

DETAILED DESCRIPTION OF THE PREFERRED EMBODIMENT

Figure 1:
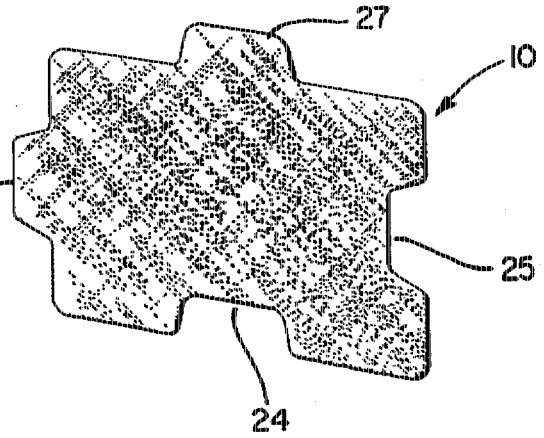
FIG. 1 is a perspective view of one embodiment of my protective cloth divider for credit cards embodying important features of my invention.
Figure 2:
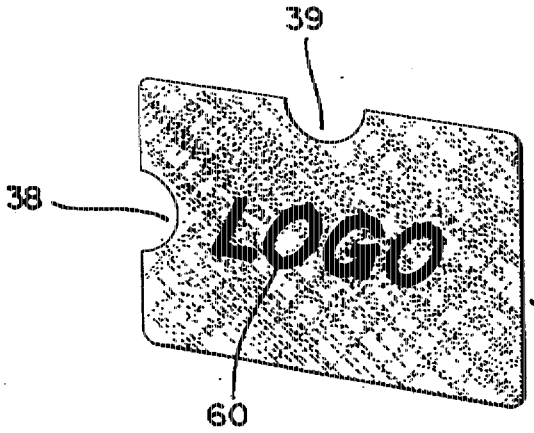
FIG. 2 is a perspective view of another embodiment of my protective cloth divider for credit cards.
Figure 3:
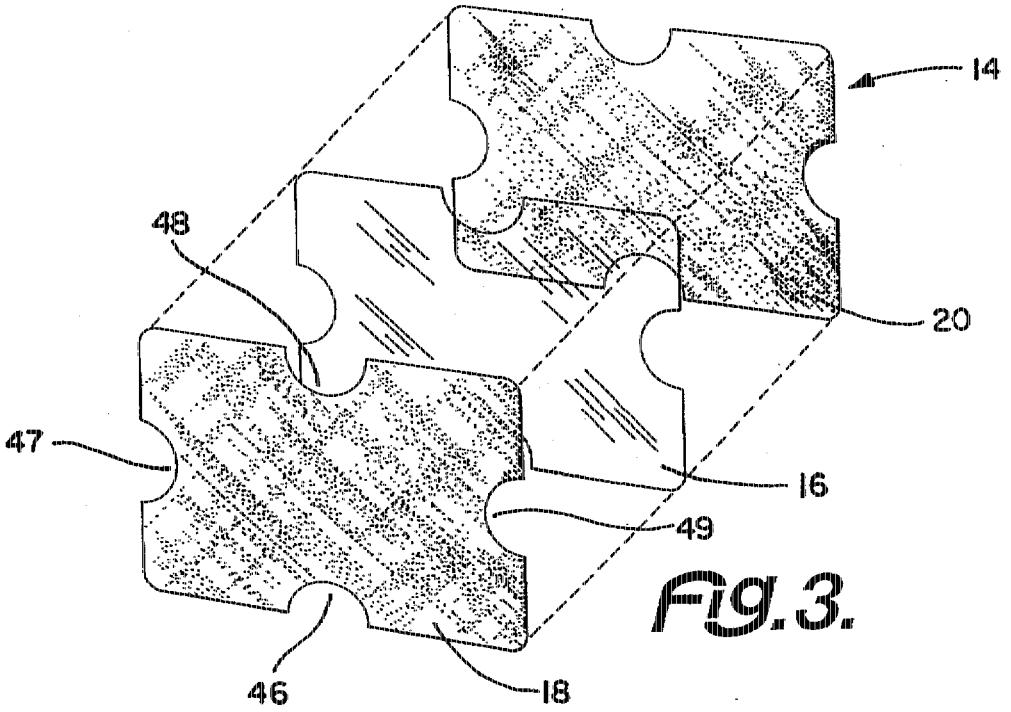
FIG. 3 is an exploded perspective view illustrating the construction of my protective cloth divider for credit cards.

Referring now to the drawings, FIG. 1 shows one embodiment of my new and improved protective cloth divider 10 for credit cards. The cloth divider 10 is substantially rectangular in configuration and is sized slightly smaller than that of a bank credit card or the like (approximately 3⅜ inches×2 1/16 inches). FIG. 2 shows another embodiment of my new and improved cloth divider 12. FIG. 3 shows yet another embodiment of my new and improved cloth divider 14 in exploded view. As can be seen more clearly in FIG. 3, all my cloth dividers 10, 12, 14 are comprised of a semi-rigid middle sheet 16. The middle sheet 16 is composed of a substantially thin piece of semi-rigid material, preferably a thin plastic. The middle sheet 16 can also be composed of various other materials such as polyester, poly-carbonate and high impact poly-styrene or any other materials that can provide a substantially thin semi-rigid construction. It is contemplated that the middle sheet 16 will have a thickness between 3 mils (0.003 inches) and 15 mils (0.015 inches).

The cloth divider further comprises a substantially thin front protective cover sheet 18 and a substantially thin back protective cover sheet 20. The front and back protective cover sheets are of the same size as the middle sheet. These sheets can consist of a variety of different materials and fabrics including polyester, cotton, nylon, poly-cotton, synthetic cloth, Teflon and Kevlar. Various other thin materials that can resist scratching the magnetic media on the back of a credit card can also be used. Excellent results can be obtained using a polyester fabric having a 70 Denier size, 2.4 oz/yd$^2$, 4.1 yds/lb, class 4.75 pilling and a warp tear strength of 3,000 grams. The pilling class of the fabric helps determine the softness of the fabric that is used, thereby being able to provide a fabric that has a texture to resist scratching when placed against a credit card. Excellent results can be achieved when the pilling class of the material or fabric is between 3.0 and 7.0, however, other pilling classes can be used as long as the material can be kept substantially thin.

It is contemplated that each of the front and back protective cover sheets will be very thin and will have a thickness between 1 rail (0.001 inches) and 15 mils (0.015 inches) thereby providing a substantially thin protective cloth divider for protecting credit cards and the like. Various different weaves of fabric can also be used, however, excellent results can be obtained by using a twill or taffeta weave to help resist scratching of credit cards. Additionally, conductive material or cloth could be used to eliminate static electricity which can ultimately damage the information coded on a magnetic strip of a credit card.

The front protective cover sheet 18 is uniformly secured to an entire front side of the middle sheet 16 and the back protective cover sheet 20 is uniformly secured to an entire back side of the middle sheet 16. The front and back protective cover sheets 18, 20 can be secured to the middle sheet 16 in numerous different ways know in the art. Different methods of securing the front and back protective cover sheets to the middle sheet include using adhesive, lamination or a combination thereof.

Excellent results can be obtained in securing the sheets together using a X1-218-A adhesive that can be purchased from Midwest Coating Incorporated in Lake Bluff, Ill. wherein 18 pounds of adhesive can be applied to 3,000 square feet of material. Preferably, the adhesive is applied to the semi-rigid middle sheet and is then cured for approximately 2 minutes in an oven to provide a tacky adhesive. The front protective cover sheet is then laminated to the middle sheet through a combination of hot and cold rollers. After lamination of the front side, the back protective cover sheet is then laminated in a similar fashion. Securing thin fabric to a semi-rigid plastic middle sheet can be accomplished in many different ways and the method described herein discloses a method that provides excellent results.

It is contemplated that the front, middle and back sheets are secured together on a large roll of material. After the front, middle and back sheets are secured together then credit card sized protective cloth dividers are cut from the material. Various different cutting methods can be used including dye cutting, laser cutting and plasma cutting. The protective cloth divider shown in FIG. 1 is shaped in such a way so as to utilize as much material as possible when being cut from a large roll of material. The U-shaped protruding tabs are positioned so as to provide U-shaped slots in the adjacent protective cloth dividers, thereby providing a cost effective way to manufacture the protective cloth dividers having U-shaped protruding tabs.

Figure 4:
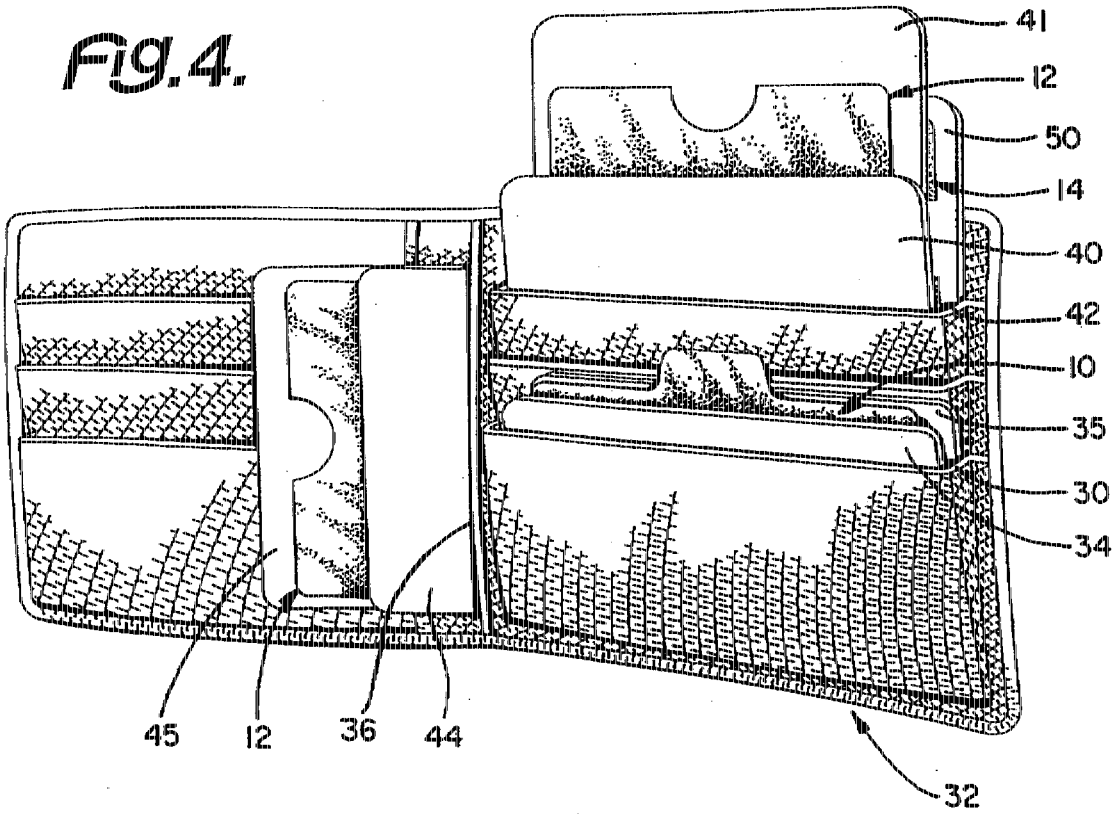
FIG. 4 is an enlarged perspective view illustrating various uses of my protective cloth divider for credit cards in a wallet.

Referring back to FIG. 1, the protective cloth divider 10 has two U-shaped slots 24, 25 and two U-shaped protruding tabs 26, 27. The slots and tabs on the protective cloth divider are provided to help a user locate and/or grasp a credit card within a wallet and to also make it easy to place a credit card back in a proper location adjacent the protective cloth divider. As seen in FIG. 4, a user may decide to use the protective cloth divider in top slot 30 in a wallet 32, therefore the user would need to cut off the side U-shaped protruding tab 26 (FIG. 1) with ordinary household scissors to provide a proper fit in between the credit cards 34, 35. If the user decides to use this embodiment in a side slot 36 in a wallet then the top U-shaped protruding tab 27 (FIG. 1) would be cut off. If the user decides not to use the U-shaped protruding tabs 26, 27, but use the U-shaped slots 24, 25 (FIG. 1), then both of the protruding tabs 26, 27 would be cut off. The protective cloth divider is specifically sized to be slightly smaller than that of a credit card to enable a user to quickly and easily remove and insert a credit card.

FIG. 2 illustrates another embodiment of my protective cloth divider wherein two U-shaped slots 38, 39 are positioned on an edge thereof. The U-shaped slots are sized to enable a person's fingers to grasp a credit card within a wallet. As can be seen in FIG. 4, this protective cloth divider 12 can be placed in between cards 40, 41 located in a top slot 42 or in between cards 44, 45 located in a side slot 36 within a wallet.

FIG. 2 further illustrates a printed logo 60 located on a front side of my protective cloth divider 12. The logo 60 can comprise of various identifying indicia such as: logos, calendars, advertisements, business cards, pictures and any other types of printed indicia.

FIG. 3 illustrates yet a further embodiment that provides U-shaped slots 46, 47, 48, 49 on all four edges of the protective cloth divider. Hence, if the user removes the protective cloth divider with the credit cards from either a top slot 42 or a side slot 36, the user is not required to make sure that the protective cloth divider is properly aligned before placing it back into the wallet in between the credit cards, thereby making it easy and convenient for a person to use. As can be seen in FIG. 4, the protective cloth divider 14 can be used in between cards 41, 50 located in a top slot 42 or in a side slot 36 similarly to the protective cloth divider 12.

As various possible embodiments may be made in the above invention for use for different purposes and as various changes might be made in the embodiments and method above set forth, it is understood that all of the above matters here set forth or shown in the accompanying drawings are to be interpreted as illustrative and not in a limiting sense.

I claim:

1. A cloth divider for protecting credit cards comprising:

a substantially thin semi-rigid middle sheet, said semi-rigid middle sheet having a thickness from between 3 mils and 15 mils, said semi-rigid middle sheet having a substantially rectangular configuration sized slightly smaller than a bank credit card;

a substantially thin front protective cover sheet, a first securing means uniformly attaching said substantially thin front protective cover sheet with a front side of said semi-rigid middle sheet, said front protective cover sheet having a thickness from between 1 mil and 15 mils, said front protective cover sheet covering said front side of said semi-rigid middle sheet and being similar in size to said semi-rigid middle sheet; and a substantially thin back protective cover sheet, a second securing means uniformly attaching said back protective cover sheet with a back side of said semi-rigid middle sheet, said back protective cover sheet having a thickness from between 1 mil and 15 mils, said back protective cover sheet covering said back side of said semi-rigid middle sheet and being similar in size to said semi-rigid middle sheet, said front protective cover sheet and said back protective cover sheet having a texture to resist scratching when placed against a credit card thereby providing a semi-rigid cloth divider for placement adjacent to credit cards within a wallet and protecting said credit cards from being damaged.

2. The cloth divider of claim 1, wherein said cloth divider has at least one U-shaped slot located on an edge of said cloth divider, whereby said U-shaped slot makes grasping of a credit card within a wallet easier.

3. The cloth divider of claim 2, wherein said cloth divider has at least one U-shaped protruding tab located on an edge of said cloth divider, said U-shaped protruding tab having a sufficient dimension to be grasped by a person's fingers whereby said protruding tab makes locating and grasping of a credit card within a wallet easier.

4. The cloth divider of claim 1, wherein said cloth divider has at least one U-shaped protruding tab located on an edge of said cloth divider, said U-shaped protruding tab having a sufficient dimension to be grasped by a person's fingers whereby said U-shaped protruding tab makes locating and grasping of a credit card within a wallet easier.

5. The cloth divider of claim 1, wherein said semi-rigid middle sheet is a plastic material.

6. The cloth divider of claim 1, wherein said front protective cover sheet and said back protective cover sheet is a material selected from the group consisting of: polyester, cotton, nylon, poly-cotton, synthetic cloth and static resistant conductive cloth.

7. The cloth divider of claim 1, wherein said first and second securing means is selected from a group consisting of: adhesive and lamination.

8. The cloth divider of claim 1, wherein said front protective cover sheet and said back protective sheet are fabrics having a weave selected from the group consisting of: twill and taffeta.

9. The cloth divider of claim 1, wherein said front protective cover sheet and said back protective cover sheet have a pilling class front between 3.0 and 7.0.

10. The cloth divider of claim 1, wherein said cloth divider has printed indicia on a from side thereof.

11. In a cloth divider for protecting credit cards having a magnetic strip, said cloth divider comprising:

a substantially thin semi-rigid middle sheet, said semi-rigid middle sheet having a thickness from between 3 mils and 15 mils, said semi-rigid middle sheet having a substantially rectangular configuration sized slightly smaller than a bank credit card;

a substantially thin front protective cover sheet, a first securing means uniformly attaching said substantially thin front protective cover sheet with a front side of said semi-rigid middle sheet, said front protective cover sheet having a thickness from between 1 mil and 15 mils, said front protective cover sheet covering said front side of said semi-rigid middle sheet and being similar in size to said semi-rigid middle sheet; and a substantially thin back protective cover sheet, a second means uniformly attaching said back cover protective cover sheet with a back side of said semi-rigid middle sheet, said back protective cover sheet having a thickness from between 1 mil and 15 mils, said back protective cover sheet covering said back side of said semi-rigid middle sheet and being similar in size to said semi-rigid middle sheet, said cloth divider having at least one U-shaped slot structure located on an edge of said cloth divider, whereby said U-shapes slot structure makes grasping of a credit card within a wallet easier, said front protective cover sheet and said back protective cover sheet having a texture to resist scratching a magnetic strip on a credit card when placed against a credit card thereby providing a semi-rigid cloth divider for placement adjacent to credit cards within a wallet and protecting said credit cards from being damaged.

12. The cloth divider of claim 11, wherein said cloth divider has at least one protruding tab located on an edge of said cloth divider, whereby said protruding tab makes locating and grasping of a credit card within a wallet easier.

13. In combination a cloth divider for protecting credit cards with a magnetic strip and a wallet, said cloth divider comprising:

a substantially thin semi-rigid middle sheet, said semi-rigid middle sheet having a thickness from between 3 mils and 15 mils, said semi-rigid middle sheet having a substantially rectangular configuration sized slightly smaller than a bank credit card;

a substantially thin front protective cover sheet, a first securing means uniformly attaching said substantially thin front protective cover sheet with a front side of said semi-rigid middle sheet, said front protective cover sheet having a thickness from between 1 mil and 15 mils, said front protective cover sheet covering said front side of said semi-rigid middle sheet and being similar in size to said semi-rigid middle sheet; and a substantially thin back protective cover sheet, a second securing means uniformly attaching said back protective cover sheet with a back side of said semi-rigid middle sheet, said back protective cover sheet having a thickness from between 1 mil and 15 mils, said back protective cover sheet covering said back side of said semi-rigid middle sheet and being similar in size to said semi-rigid middle sheet, said front protective cover sheet and said back protective cover sheet having a texture to resist scratching when placed against a credit card thereby providing a semi-rigid cloth divider for placement adjacent to credit cards within the wallet and protecting said credit cards from being damaged.

14. The combination of claim 13, wherein, said cloth divider has at least one U-shaped slot located on an edge of said cloth divider, whereby said U-shaped slot makes grasping of a credit card within a wallet easier.

15. The combination of claim 14, wherein said cloth divider has at least one U-shaped protruding tab located on an edge of said cloth divider, said U-shaped protruding tab having a sufficient dimension to be grasped by a person's lingers whereby said protruding tab makes locating and grasping of a credit card within a wallet easier.

16. The combination of claim 13, wherein said cloth divider has at least one U-shaped protruding tab located on an edge of said cloth divider, said U-shaped protruding tab having a sufficient dimension to be grasped by a person's lingers whereby said U-shaped protruding tab makes locating and grasping of a credit card within a wallet easier.

17. The combination of claim 13, wherein said semi-rigid middle sheet is a plastic material.

* * * * *